US008035064B1

(12) United States Patent
Fish

(10) Patent No.: US 8,035,064 B1
(45) Date of Patent: Oct. 11, 2011

(54) HEATING UNIT FOR REFRIGERANT CHARGING CYLINDERS

(76) Inventor: Craig Fish, Sandusky, OH (US)

( * ) Notice: Subject to any disclaimer, the term of this patent is extended or adjusted under 35 U.S.C. 154(b) by 515 days.

(21) Appl. No.: 11/646,628

(22) Filed: Dec. 28, 2006

Related U.S. Application Data

(60) Provisional application No. 60/755,937, filed on Dec. 30, 2005.

(51) Int. Cl.
*H05B 3/06* (2006.01)
*F24H 1/18* (2006.01)

(52) U.S. Cl. ..... 219/526; 219/528; 219/529; 219/211; 219/212; 219/535; 219/544; 219/545; 219/548; 219/549; 392/444; 62/149; 417/207

(58) Field of Classification Search ..... 219/528, 219/529, 211–12, 526, 535, 544–5, 548–9; 392/459, 444; 62/149; 417/207
See application file for complete search history.

(56) References Cited

U.S. PATENT DOCUMENTS 5,827,050 A * 10/1998 Price ..... 417/207

* cited by examiner

*Primary Examiner* — Shawntina Fuqua
(74) *Attorney, Agent, or Firm* — Jerry Semer

(57) ABSTRACT

The product is basically a heating blanket that is adapted in size to fit around a canister of refrigerant used to recharge heat pumps, air conditioners and refrigerators in a commercial or home setting. The blanket has a heating element within it which heats the canister when placed around the canister. From one corner of the blanket is an electrical cord which runs to a small control unit and then to a plug that fits a common 110 voltage household outlet. The control unit consists of a fitting that is designed to be attached to the valve on the top of the refrigerant canister. This fitting is attached to a pressure sensitive valve that sense the pressure of the refrigerant that passes through the valve. This pressure sensitive valve turns off the flow of electric to the blanket when the gas hits a certain pressure.

17 Claims, 5 Drawing Sheets

HEATING UNIT FOR REFRIGERANT CHARGING CYLINDERS

This application is a continuation-in-part of prior applications No. 60/755,937 that was filed on Dec. 30, 2005.

FIELD OF INVENTION

This invention relates to the field of device for heating the charging cylinders containing refrigerant for a refrigeration system or air conditioning, and more particularly to a heating unit that heats a cylinder refrigerant and keeps the cylinder's refrigerant at a specific pressure.

BACKGROUND OF THE INVENTION

Heating and air conditioning systems are usually designed to be recharged with refrigerant at a certain given pressure. The refrigerant usually comes in a cylinder under pressure. The pressure for recharging an air conditioning system is usually the pressure of the gas when the outside temperature of the cylinder is around 70 degrees. Of course, these cylinders are made out of metal and thus, the inside gas and liquid are at the temperature of the outside air. When the temperature drops below 70 degrees Fahrenheit, the pressure within the cylinder also drops. The inventor has found that in the art there is no effective way of heating the cylinder. Most individuals in the field usually heat their cylinders by approximately two different methods.

The first method is by placing the cylinder in a tub of hot water. The problems with this method is that you must get a tub of hot water to heat the cylinder. On a reasonably cold day if you are working outside you may need a few tubs of hot water before you can get the cylinder up to the working temperature. This method also takes a reasonably long time to bring the cylinder up to temperature. A much faster, however, far more dangerous method is to heat the cylinder with a blow torch. The big problem with this is if overheat the cylinder will explode. Thus, one of the objectives of this invention is to heat the cylinder quickly and thus save time on the job. The second objective of this invention is to heat the cylinder safely. Applicant's invention will heat the cylinder, not only quickly, but also safely and will shut off the heat when the cylinder reaches the proper temperature. Another objective of the invention is to make it easy to operate and easy to store within the individual's van or truck when he is going out or coming home from repressurizing a heating and air conditioning system. Another objective is to make the system inexpensive to produce and manufacture. The features that achieve these goals is that the applicant has created a heating blanket that wraps around the cylinder and heats the cylinder to the specific temperature. Applicant controls this temperature by using a pressure valve and when the refrigerant reaches the proper temperature, the heat system is shut off. Thus, the system not only quickly heats the refrigerant cylinder but also safely heats the cylinder.

SUMMARY OF THE INVENTION

The product is basically a heating blanket that is adapted in size to fit around a canister of refrigerant used to recharge heat pumps, air conditioners and refrigerators in a commercial or home setting. The blanket has a heating element within it which heats the canister when placed around the canister. From one corner of the blanket is an electrical cord which runs to a small control unit and then to a plug that fits a common 110 voltage household outlet. The control consists of a fitting that is designed to be attached to the valve on the top of the refrigerant canister to be warmed. This fitting is attached to a pressure sensitive valve that is sensitive to the pressure from the canister of refrigerant which passes through the valve at the top of the canister and through the fitting to the pressure sensitive valve. This pressure sensitive valve turns off the flow of electric to the blanket when the gas hits a certain pressure, thus, turns off the heater when the canister pressure has risen to a certain point. The electric passing from the household outlet to the blanket through the line is controlled by a pressure sensitive control unit placed on this electrical cord.

DETAILED DESCRIPTION OF THE PREFERRED EMBODIMENT

Figure 1:
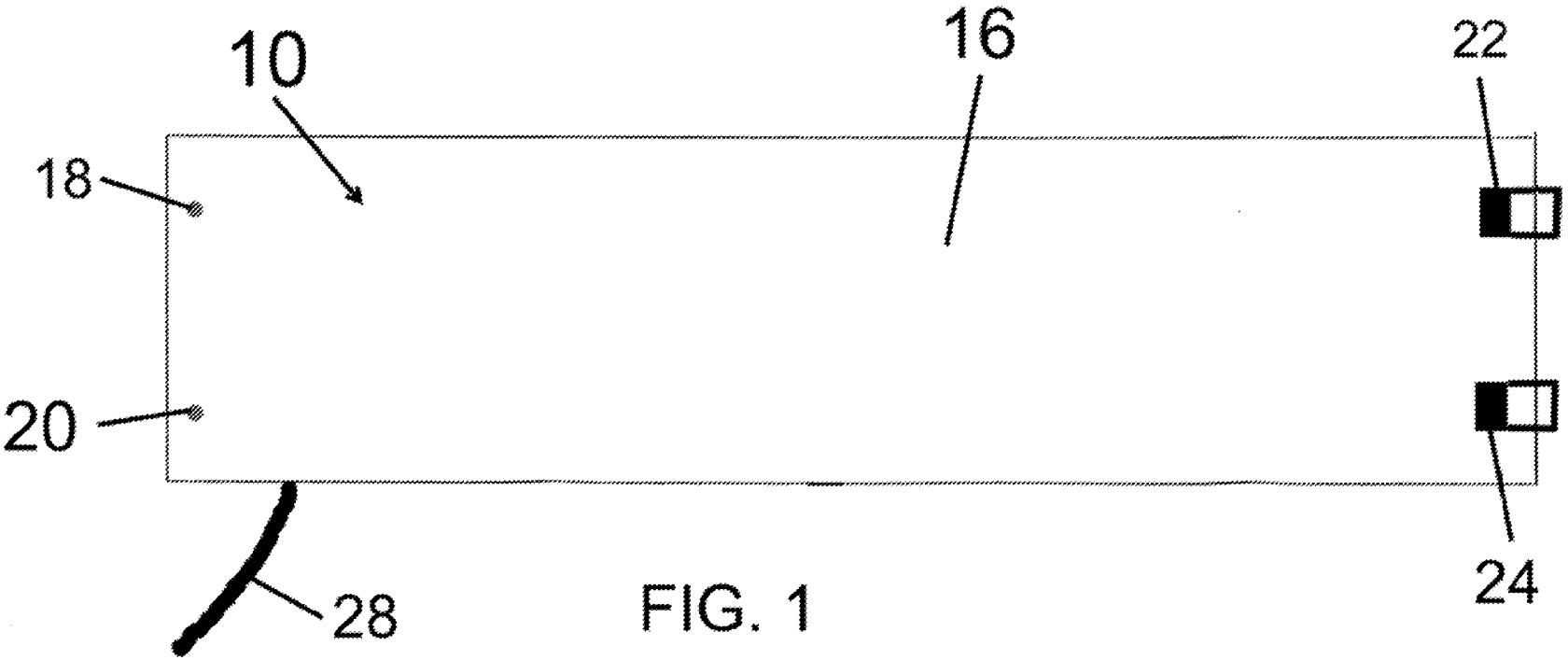
FIG. 1 is a front view of the invention.

FIG. 1 is a front view of the invention. FIG. 1 shows the heating blanket 10. Heating blanket 10 is of the size that it can fit around a canister 12 of refrigerant used to recharge heating pumps, air conditioner, and refrigeration units. The heating blanket 10 is made out of semi-flexible material. In the preferred embodiment the blanket is made out of a thin piece of flexible stainless steel 16 which distributes heat well upon which a heating element 14 is placed. The heating blanket can also be made out of a material that when electric flows through it, will produce heat. This heating element 14 can be a common electric resistant heater that is flexible. In the preferred embodiment the inventor has used a heating element which is approximately 90 square inches and produces about 5 watts per square inch.

Figure 2:
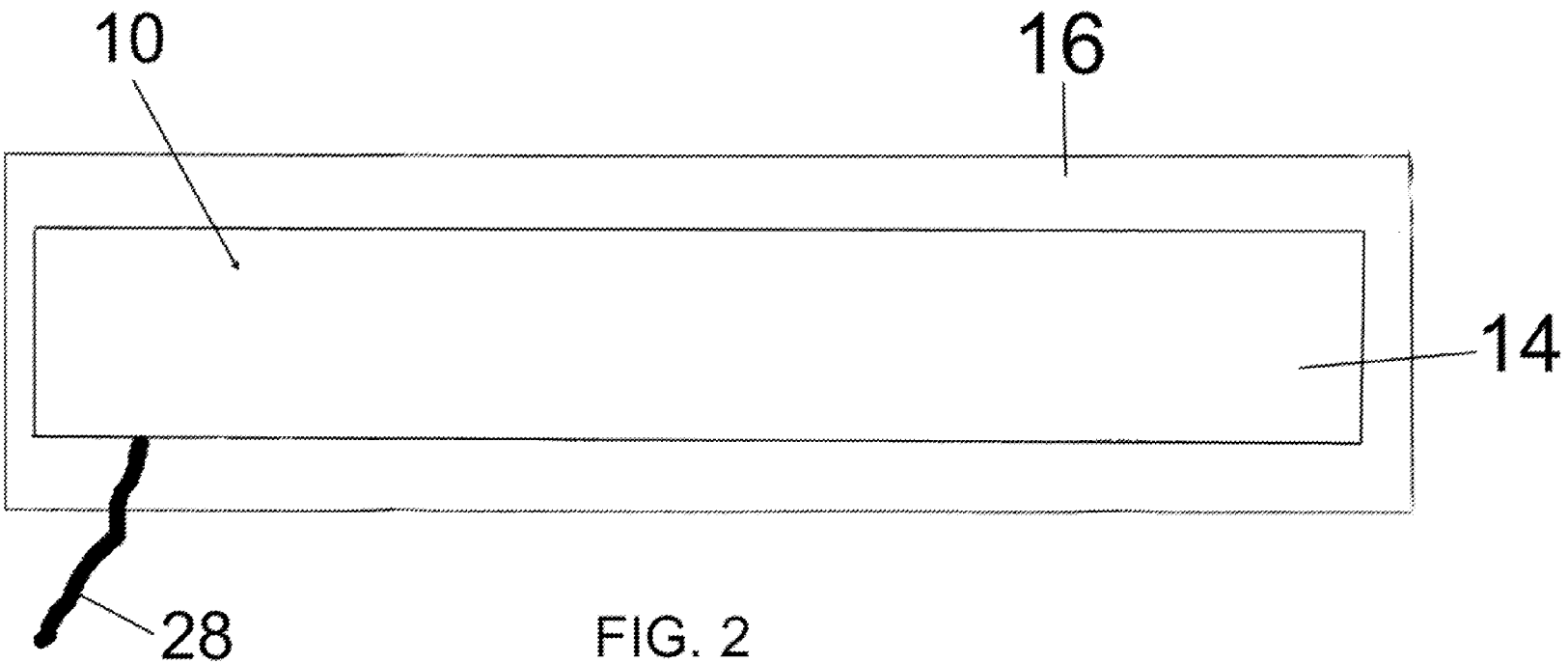
FIG. 2 is a back view of the invention.

FIG. 2 shows the back side of the heating blanket 10 shown in FIG. 1. In FIG. 2 one sees the heating element 14 that is placed through the middle of the flexible stainless steel 16.

FIG. 1 shows the top side of the heating blanket 10 where we only see the flexible stainless steel 16. On one end of the flexible stainless steel 16 is placed two locking devices 18 and 20. On the other end of the heating blanket are placed two posts 22 and 24. The two locking devices 18 and 20 are designed so that when the blanket 10 is placed around a refrigerant canister 12, the locking device 18 and 20 will pass over and around the posts 22 and 24 and lock the posts 22 and 24 in place holding the heating blanket 10 on the refrigerant canister 12. There are, of course, many ways known in the art to attach the heating blanket 10 to the refrigerant canister 12. Instead of the locking devices 18 and 20 and the post 22 and 24, one could use snaps, hooks, or other devices known in the art to hold the heating blanket 10 around the refrigerant canister. Also, it is not necessary for the heating blanket 10 to fully encircle the refrigerant canister 12. The heating blanket 10 just has to make contact with the refrigerant canister 12 with enough surface area to heat the refrigerant quickly. The heating blanket 10 could be attached with magnets or be made in a cylindrical shape and the canister placed within. Out of one corner of the heating blanket 10 is run a cord 28. This cord 28 is attached to the heating element 14 of the heating blanket 10 and runs to a plug that fits in a normal household 110 volt outlet. The cord 30 runs through a control unit 32.

Figure 3:
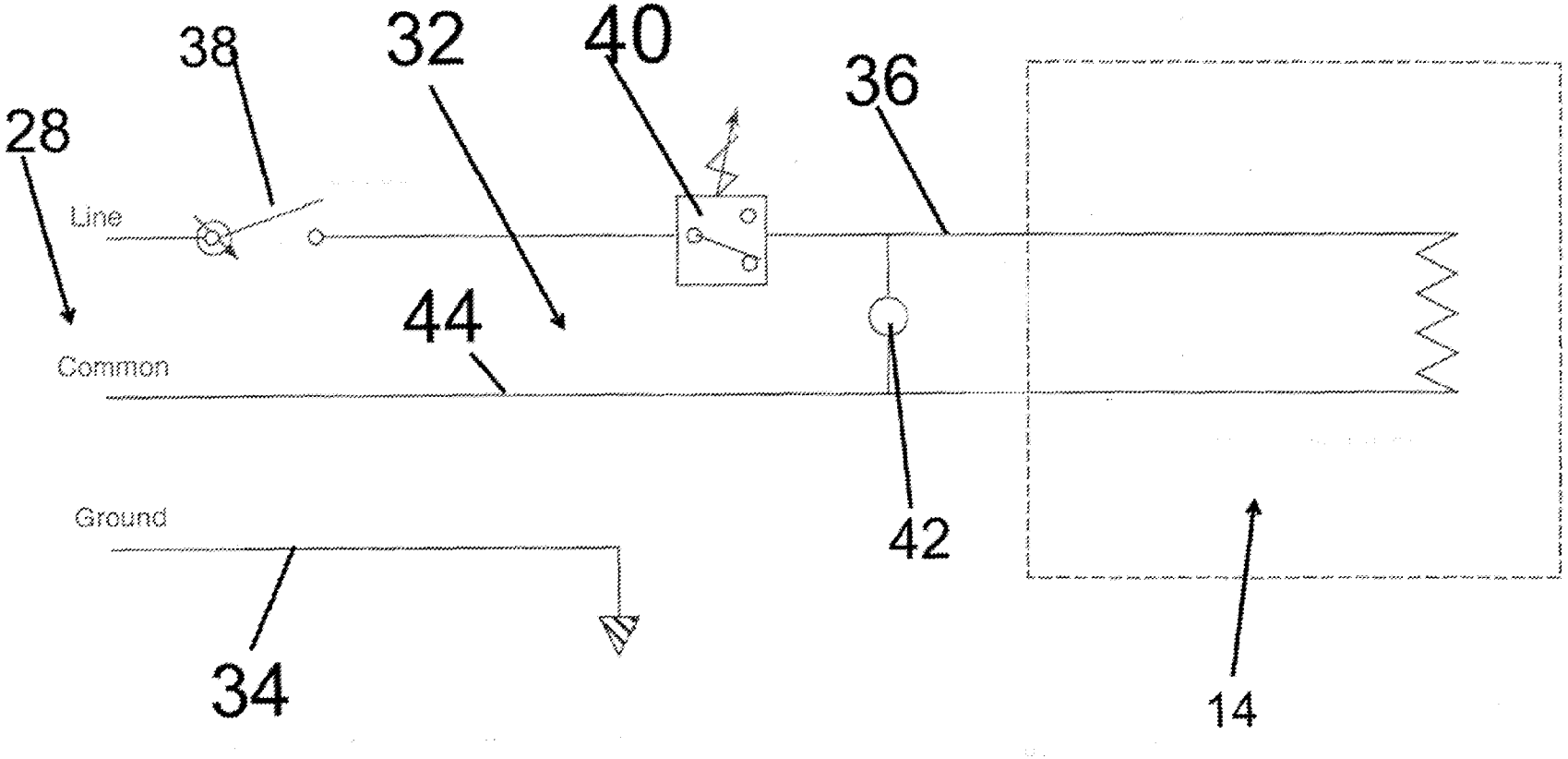
FIG. 3 is the electrical schematic of the invention.

FIG. 3 shows the electrical schematic of the unit. FIG. 3 shows the heating blanket 10 in which the heating element 14 is located. The electricity from the cord 28 runs through this heating element 14. On the other end of the cord 28 is a plug. This plug, as stated above, plugs into a normal 110 outlet. A normal 110 outlet has three wires. One is to ground 34 and in the schematic is grounded. The second line 36 is the electric which runs to a power switch 38 that is within the control unit 32. Power switch 38 can be seen on the outside of the control unit 32 and is the on/off switch for turning on and off the control unit 32. The second line 36 continues and runs to a pressure switch 40. The pressure switch 40 stay on until the pressure upon the switch reaches a certain point which disconnects the second line 36 and thus cuts off the electric to the heating element 14. The common line 44 runs from the pressure switch 40 to a lamp 42 which is hooked up in a parallel across the second line 36 and the common line 44. The lamp tells whether there is electric power running to the heating element 14. From the lamp 42 the electric then runs through the heating element 14 and then back through the common line 44 to the plug 30.

Figure 4:
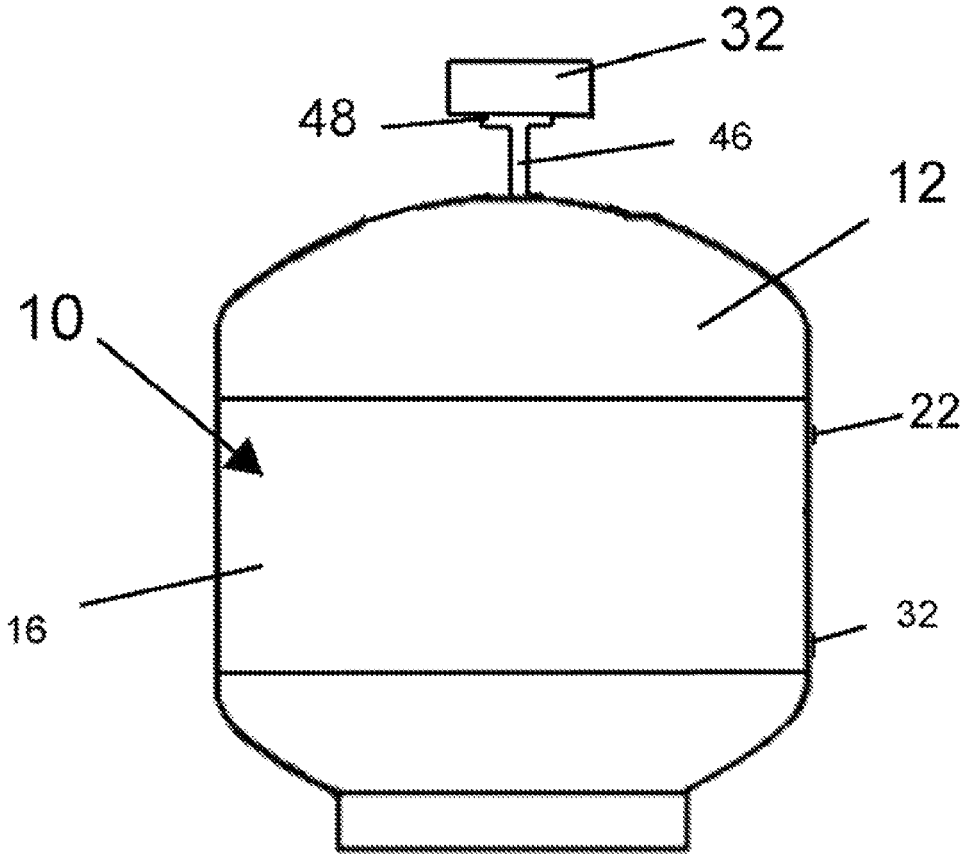
FIG. 4 is a view of the invention when it is attached around a refrigeration canister.
Figure 5:
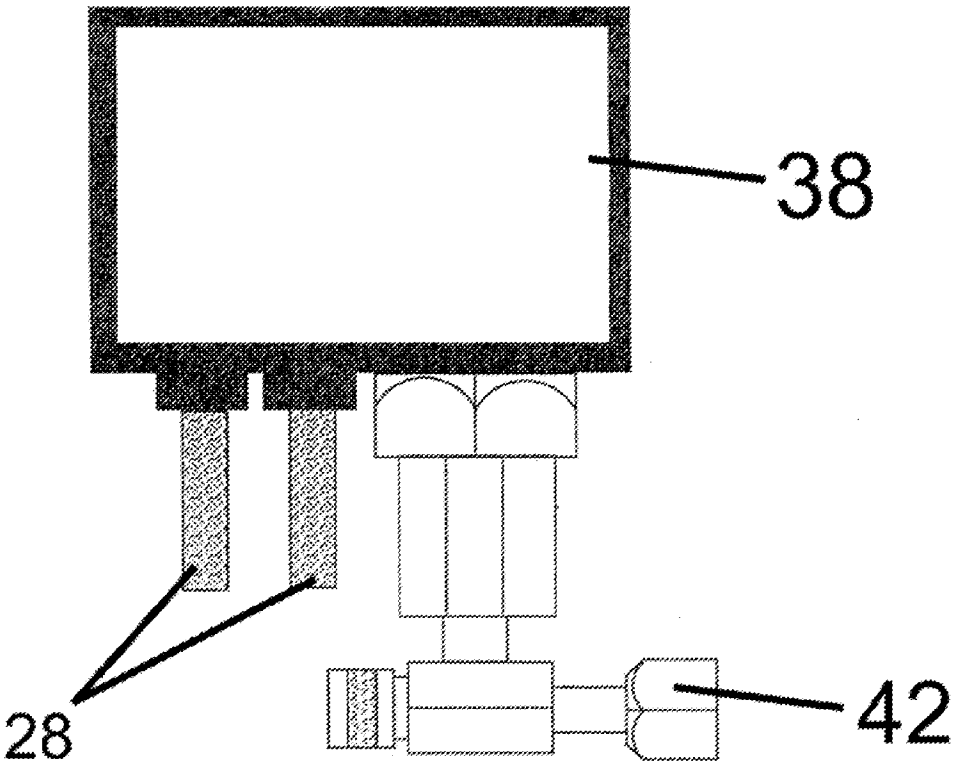
FIG. 5 is a view of the control unit.

FIG. 4 shows the invention on a refrigerant canister 12. As one can see, the heating blanket 10 fits around the refrigerant canister 12 to heat the refrigerant canister 12. The control unit 32 shown in FIG. 5 fits on the valve 46 on the top of the refrigerant canister 12. The control unit 32 has a fitting 48 that attaches to the valve 46 on the top of the refrigerant canister 12. When the refrigerant canister's valve 46 is open the refrigerant moves through the valve 46 on the top of the refrigerant canister 12 and through the fitting 48 and into the control unit 32 up against the pressure switch 40. This pressure switch 40 is designed so that when the pressure of the refrigerant gets to a certain point the pressure switch 40 will turn off the heating element 14 and thus, stop the heating blanket 10 from heating the canister 12. By using this pressure switch 40, the inventor has designed a system that can heat the refrigerant canister 12 quickly, however, is safe since when the canister 12 reaches a certain pressure the heater is turned off. Thus, there is no chance of overheating the canister 12 to the point where the refrigerant explodes. The invention is quite simple to use. One first takes the refrigerant canister 12 and places the heating blanket 10 around it and pulls locking devices 18 and 20 over post 22 and 24 and clamps the locking devices 18 and 20 against the posts 22 and 24 to hold the heating blanket 10 securely upon the canister 12. Then one takes the control unit 32 and places the fitting 48 on the bottom of the control unit 32 on the valve 46 on the top of the refrigerant canister 12. Then one turns the valve 46 on the top of the refrigerant canister 12 allowing the refrigerant to make contact with the pressure switch 40 within the control unit 32. Then one plugs the electric cord 28 into a common household electric outlet and switches on the power switch 38 on the control unit. The blanket 10 will then begin to heat up the refrigerant canister 12. When the refrigerant is fully heated to the proper pressure, the control unit's 32 pressure switch 38 will turn off the electric. This will also turn off the lamp 42 on the control unit 32 allowing the individual who is doing the refrigeration to know that the refrigerant is fully heated to the proper pressure. Then one just takes the refrigerant canister and attaches it to the refrigeration system and recharges the system. Thus, this enables the workmen on a cold day to reheat the refrigerant to the proper temperature quickly, easily and safely.

Changes and modifications in the specifically described embodiments can be carried out without departing from the scope of the invention which is intended to be limited only by the scope of the appending claims.

I claim:

1. A device for heating a canister of refrigerant comprising:

a. a heating element; and, b. a blanket to which the heating element is attached, and said blanket partially encircle the canister of refrigerant; and, c. a component that allows the heating element to be attached to a power supply that is able to power the heating element; and, d. a control unite that monitors the pressure of the refrigerant within the canister and regulates the power going to the heating element from the power supply in accordance with the pressure of the refrigerant within the canister and said control unit is attached to the canister of refrigerant.

2. A device for heating a canister of refrigerant as in claim 1 further comprising:

a. the blanket wraps around the canister and attaches to itself.

3. A device for heating a canister of refrigerant as in claim 2 further comprising:

a. the blanket has two ends and one end of the blanket contains a locking device and the other end of the blanket contains a post and when the blanket is wrap around the canister and the locking device is locked to the post holding the blanket securely on the canister.

4. A device for heating a canister of refrigerant as in claim 1, wherein:

a. the component that allows the heating element to be attached to a power supply that is able to power the heating element is a power cord that plugs into a wall electric outlet.

5. A device for heating a canister of refrigerant as in claim 4, wherein:

a. the power cord plugs into a 110 wall electric outlet.

6. A device for heating a canister of refrigerant as in claim 1, wherein:

a. the control unite is able to stop the flow of power to the heating element when the pressure of the refrigerant within the canister raise to a prescribed point.

7. A device for heating a canister of refrigerant as in claim 6, wherein:

a. the canister has a valve that allows the refrigerant to flow out of the canister and said valve controls the flow of refrigerant from the canister; and, b. the control unite comprises:

(1) a first control value that attaches to the valve on the canister that allows the refrigerant to flow out of the canister and said control value allows the refrigerant to flow into the control unite; and, (2) a pressure sensitive switch attached to the first control value such that it is able to sense the pressure of the refrigerant flow through the first control value and said pressure sensitive switch is attached to the component that allows the heating element to be attached to a power supply that is able to power the heating element and said pressure sensitive switch is able to shut off the flow of power to the heating element when the pressure of the refrigerant flowing through the first control value reaches a certain point; and, (3) a second control value that allows refrigerant to flow through it attach to the first control value such that the refrigerant flows into the control unite through the first control value and out of the control unite through the second control value.

8. A device for heating a canister of refrigerant as in claim 2, wherein:

a. the component that allows the heating element to be attached to a power supply that is able to power the heating element is a power cord that plugs into a wall electric outlet.

9. A device for heating a canister of refrigerant as in claim 8, wherein:

a. The power cord plugs into a 110 wall electric outlet.

10. A device for heating a canister of refrigerant as in claim 2, wherein:

a. the control unite is able to stop the flow of power to the heating element when the pressure of the refrigerant within the canister raise to a prescribed point.

11. A device for heating a canister of refrigerant as in claim 4, wherein:

a. the control unite is able to stop the flow of power to the heating element when the pressure of the refrigerant within the canister raise to a prescribed point.

12. A device for heating a canister of refrigerant as in claim 8, wherein:

a. the control unite is able to stop the flow of power to the heating element when the pressure of the refrigerant within the canister raise to a prescribed point.

13. A device for heating a canister of refrigerant as in claim 9, wherein:

a. the control unite is able to stop the flow of power to the heating element when the pressure of the refrigerant within the canister raise to a prescribed point.

14. A device for heating a canister of refrigerant as in claim 13, wherein:

a. the canister has a valve that allows the refrigerant to flow out of the canister and said valve controls the flow of refrigerant from the canister; and, b. the control unite comprises:

(1) a first control value that attaches to the valve on the canister that allows the refrigerant to flow out of the canister and said control value allows the refrigerant to flow into the control unite; and, (2) a pressure sensitive switch attached to the first control value such that it is able to sense the pressure of the refrigerant flow through the first control value and said pressure sensitive switch is attached to the component that allows the heating element to be attached to a power supply that is able to power the heating element and said pressure sensitive switch is able to shut off the flow of power to the heating element when the pressure of the refrigerant flowing through the first control value reaches a certain point; and, (3) a second control value that allows refrigerant to flow through it attach to the first control value such that the refrigerant flows into the control unite through the first control value and out of the control unite through the second control value.

15. A device for heating a canister of refrigerant as in claim 11, wherein:

a. the canister has a valve that allows the refrigerant to flow out of the canister and said valve controls the flow of refrigerant from the canister; and, b. the control unite comprises:

(1) a first control value that attaches to the valve on the canister that allows the refrigerant to flow out of the canister and said control value allows the refrigerant to flow into the control unite; and, (2) a pressure sensitive switch attached to the first control value such that it is able to sense the pressure of the refrigerant flow through the first control value and said pressure sensitive switch is attached to the component that allows the heating element to be attached to a power supply that is able to power the heating element and said pressure sensitive switch is able to shut off the flow of power to the heating element when the pressure of the refrigerant flowing through the first control value reaches a certain point; and, (3) a second control value that allows refrigerant to flow through it attach to the first control value such that the refrigerant flows into the control unite through the first control value and out of the control unite through the second control value.

16. A device for heating a canister of refrigerant as in claim 12, wherein:

a. the canister has a valve that allows the refrigerant to flow out of the canister and said valve controls the flow of refrigerant from the canister; and, b. the control unite comprises:

(1) a first control value that attaches to the valve on the canister that allows the refrigerant to flow out of the canister and said control value allows the refrigerant to flow into the control unite; and, (2) a pressure sensitive switch attached to the first control value such that it is able to sense the pressure of the refrigerant flow through the first control value and said pressure sensitive switch is attached to the component that allows the heating element to be attached to a power supply that is able to power the heating element and said pressure sensitive switch is able to shut off the flow of power to the heating element when the pressure of the refrigerant flowing through the first control value reaches a certain point; and, (3) a second control value that allows refrigerant to flow through it attach to the first control value such that the refrigerant flows into the control unite through the first control value and out of the control unite through the second control value.

17. A device for heating a canister of refrigerant as in claim 13, wherein:

a. the canister has a valve that allows the refrigerant to flow out of the canister and said valve controls the flow of refrigerant from the canister; and, b. the control unite comprises:

(1) a first control value that attaches to the valve on the canister that allows the refrigerant to flow out of the canister and said control value allows the refrigerant to flow into the control unite; and, (2) a pressure sensitive switch attached to the first control value such that it is able to sense the pressure of the refrigerant flow through the first control value and said pressure sensitive switch is attached to the component that allows the heating element to be attached to a power supply that is able to power the heating element and said pressure sensitive switch is able to shut off the flow of power to the heating element when the pressure of the refrigerant flowing through the first control value reaches a certain point; and, (3) a second control value that allows refrigerant to flow through it attach to the first control value such that the refrigerant flows into the control unite through the first control value and out of the control unite through the second control value.

* * * * *